United States Patent [19]

Austruy et al.

[11] Patent Number: 4,719,878

[45] Date of Patent: Jan. 19, 1988

[54] INSTALLATION FOR HEATING LIQUIDS AT DIFFERENT TEMPERATURE LEVELS

[75] Inventors: Georges Austruy, Villetaneuse; Francois Cagnon, Paris; Denis Di Paola, Argentueil; André Vinchon, Paris, all of France

[73] Assignee: Gaz de France, France

[21] Appl. No.: 883,739

[22] Filed: Jul. 9, 1986

[30] Foreign Application Priority Data

Jul. 17, 1985 [FR] France ..... 85 10974

[51] Int. Cl.[4] ..... F22B 1/02

[52] U.S. Cl. ..... 122/31 R; 122/31 A; 126/360 R; 126/360 A

[58] Field of Search ..... 122/31 R, 31 A, 28; 126/360 R, 306 A

[56] References Cited

U.S. PATENT DOCUMENTS 2,594,063 4/1952 Norman ..... 126/360 A X
2,611,362 9/1952 Swindin ..... 126/360 A
2,981,250 4/1961 Stewart ..... 126/360 A
3,716,045 2/1973 Vollhardt ..... 126/360 A
4,018,216 4/1977 Thurley ..... 122/31 A
4,393,815 7/1983 Pedersen et al. .

FOREIGN PATENT DOCUMENTS 2550614 2/1985 France .

*Primary Examiner*—Edward G. Favors
*Attorney, Agent, or Firm*—Steinberg & Raskin

[57] ABSTRACT

The present invention relates to a process and installation for heating liquids at different levels of temperature, comprising a first vat containing a first liquid heated by an exchanger immersed in this liquid and connected to the exit of a burner, and a second vat containing a second liquid into which a diffusing system is immersed and connected to the exit of the exchanger, while a pump ensures the transfer of the liquid from one vat to the other.

5 Claims, 3 Drawing Figures

INSTALLATION FOR HEATING LIQUIDS AT DIFFERENT TEMPERATURE LEVELS

BACKGROUND OF THE INVENTION

The essential object of the present invention is to provide a heating process for industrial liquids at different levels of temperature.

It also refers to an installation for carrying out this process.

In industry, liquids at two different levels of temperature are frequently used.

In this connection, for instnace, in such fields as surface treatment, textile, chemical and agrofood industries, or the hot water production, the utilization of liquids at a high temperature, for example higher than 60° C., or at a balanced temperature, for example lower than or equal to 60° C., is often required.

In this connection, means for heating industrial liquids at different levels of temperature has already been proposed.

As a result, to heat a liquid at a high temperature between 60° and 100° C. for example, a burner is commonly used the exit of which is connected to a tube or an exchanger immersed in the liquid to be heated.

Likewise, the submerged combustion process is commonly used to heat a liquid at a temperature lower than 60° C.; this process consists in diffusing or bubbling in this liquid hot gases getting out from a burner or an appropriate hot gas source for example.

However, both of the above-mentioned processes, requiring an immersed exchanger and a submerged combustion, have up to now always been used separately and accordingly were requiring separated equipments, which was of course expensive and not easy to handle.

SUMMARY OF THE INVENTION

As a result, the present invention has for its object a process and an installation which remedy the above-mentioned drawbacks and present a high efficiency especially in such fields as the heating yield, the possibility of regulating temperature at the level required, the heated liquid.

Accordingly, the invention has for its object a process for heating a first liquid in a vat or the like with the help of a tube or an exchanger connected to a burner and immersed in said vat, characterized by the simultaneous heating of a portion of this first liquid or of a second liquid contained in a second vat with the combustion gases exiting from said tube or exchanger and bubbled in this second liquid so as to heat the same at a temperature lower than that of the first liquid.

As a result, it will be understood that it becomes possible to obtain simultaneously one liquid or two different liquids at two levels of temperature, which is particularly desirable for use in industry.

According to another feature of the process, it is possible to transfer liquids from one vat to the other by means of overflowing or pumping.

Consequently, this allows making the necessary energy balance in the two vats, because the energetic needs of the two vats vary of course as a function of the use of the two liquids to be made.

According to another embodiment according to this process, the combustion gases exiting from said tube or exchanger and bubbled in the liquid of the second vat are used to pre-heat a third liquid which flows through a liquid exchanger immersed in the liquid of the second vat and which is mixed to the liquid of the first vat.

Such a way of proceeding is useful where the third liquid is not, from a chemical standpoint, compatible with the fumes or the combustion gases which consequently must not come into direct contact with the third liquid.

It will be also specified here that the first liquid can, according to the invention, be heated in the first vat at a temperature higher than 60° C., while the second liquid is heated in the second vat at a temperature lower than or equal to 60° C.

The invention also relates to a heating installation for carrying out the above-mentioned process, and of the type comprising a vat or the like containing a first liquid heated by an exchanger or tube immersed in this liquid and connected to the exit of a burner, characterized in that the exit of said tube or exchanger is connected to means for diffusing hot gases exiting from the exchanger, said means being immersed into a portion of the first liquid or in a second liquid contained in a second vat associated to the first one.

According to another feature of the installation, the first and second vat form one and the same vat separated by a partition-wall or the like Then, it will be understood that, according to the invention, a single system is provided to heat liquids at two levels of temperature.

According to another feature of the installation, it is provided a pump equipped with an inlet and outlet duct immersed in the two vats, respectively.

According to a particular embodiment of this installation, a second exchanger is immersed in the second liquid of the second vat and comprises a liquid-supply duct and an outlet duct of this liquid leading into the first vat.

The second exchanger is preferably arranged above the means diffusing the hot gases out from the exchanger or tube immersed in the liquid of the first vat.

BRIEF DESCRIPTION OF THE DRAWINGS

But other characteristics and advantages of the invention will appear more clearly from the detailed description with reference to the appended drawings, wherein.

DESCRIPTION OF THE PREFERRED EMBODIMENTS

Figure 1:
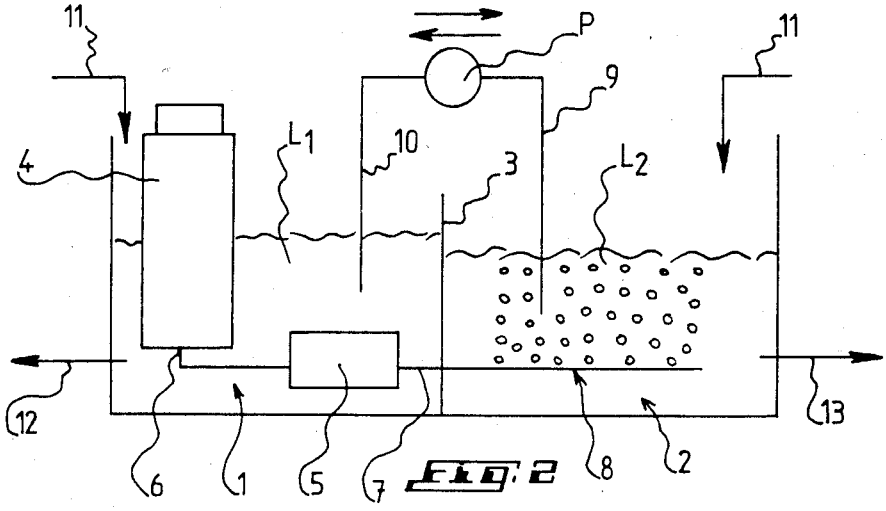
FIG. 1 is a diagrammatic view of an installation according to the invention.

According to a preferred embodiment, and referring more particularly to FIG. 1, an installation according to the invention essentially comprises two vats 1 and 2, and heating means immersed and connected to heat respectively at different levels of temperature liquids $L_1$ and $L_2$ contained in vats 1 and 2, respectively.

These vats 1 and 2 can be constituted by two vats separated from each other and directly adjacent, or can also form one and the same vat separated by a partition-wall as shown in 3.

An exchanger 5, connected to the exit 6 of a burner 4, for example of the counter-rotation type, is immersed in the liquid $L_1$ of the first vat 1. This exchanger 5, which can be a simple immersed tube, is connected through a duct portion 7 to a diffusing system diagrammatically shown in 8 and immersed in the liquid $L_2$ of the second vat 2.

A pump P provided with an inlet and outlet duct 9 and 10 deeping into the vats 1 and 2 permits the transfer of the liquid from one vat to the other.

This transfer of liquid can be effected without a pump, that is to say simply by overflowing the liquid from one vat to the other.

It is diagrammatically shown in 11 a liquid supply in the vats 1 and 2, and it is shown in 12 and 13, respectively, a duct allowing the drawing-off of the liquid $L_1$ and $L_2$ after heating, it being understood that the liquids so drawn-off are sent to any utilization.

The operation of the installation shown on FIG. 1 is as follows.

The combustion products exiting from the burner 4 go through the exchanger 5 and due to a thermal exchange with the liquid $L_1$, this latter is heated at a temperature higher than 60° C. for example. The fumes exiting out in 7 from the exchanger 5 are diffused by bubbling into the vat 2 where the liquid $L_2$ is heated at a temperature level lower than or equal to 60° C. for example.

The liquid transfer from one vat to the other through the pump P permits to supply the two vats 1 and 2 with the necessary energy balance.

So, it will be understood that with the help of a single and compact heating system, one obtains in the two vats, respectively, the heating of the two liquids at two different levels of temperature.

The calculations affected on the installation shown on FIG. 1 have shown that, with a supply of cooled liquid at 15° C. through the duct 11, with a liquid at a temperature up to 90° C. drawn off through the duct 12 and with a liquid at a temperature up to 50° C. drawn off throug the duct 13 of the vat 2, a heating yield of 102%, based on the net heating value can be obtained.

Of course, the global heating yield of the assembly depends on the reference temperature of the vat 2. And it was established that generally, whatever the temperature level of the vat 1, which temperature is higher than 60° C., the yield varies from 110 to 96% on the net heating value for temperatures between 20° C. and 60°0 C. in the vat 2.

Figure 2:
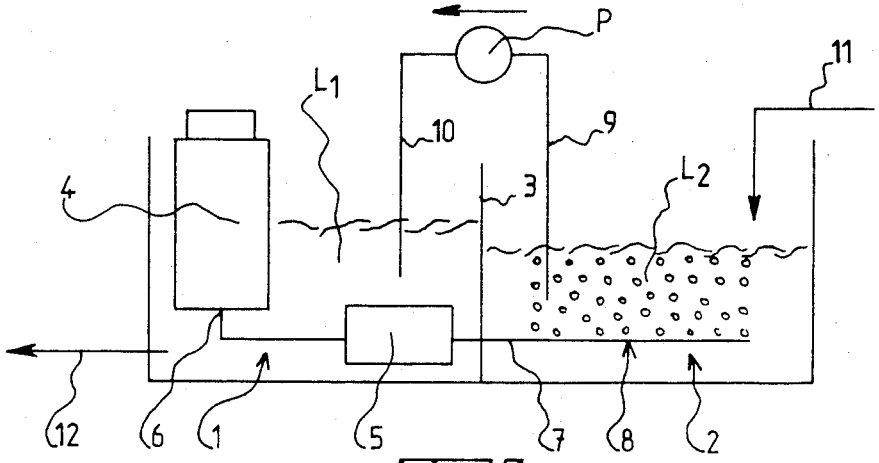
FIG. 2 is a diagrammatic view showing another embodiment of this installation.

On the embodiment shown on FIG. 2, the same reference numerals have been used than those shown on FIG. 1 for designating the same elements.

However, it will be pointed out that there is no longer drawing off from the vat 2, and that the pump P only ensures the transfer of the liquid $L_2$ from the vat 2 into the vat 1.

The installation shown on FIG. 2 permits for example heating the liquid $L_1$ in the vat 1, so as to obtain for example hot water at a temperature higher than 60° C., and with heating yields higher than 100% on the net heating value.

The calculations effected on this installation have shown that with a supply of cooled liquid at 15° C. through the duct 11, a temperature of 35° C. of the liquid $L_2$ in the vat 2, and a temperature of 95° C. of the liquid $L_1$ in the vat 1, a yield of 107% on the net heating value can be obtained.

Figure 3:
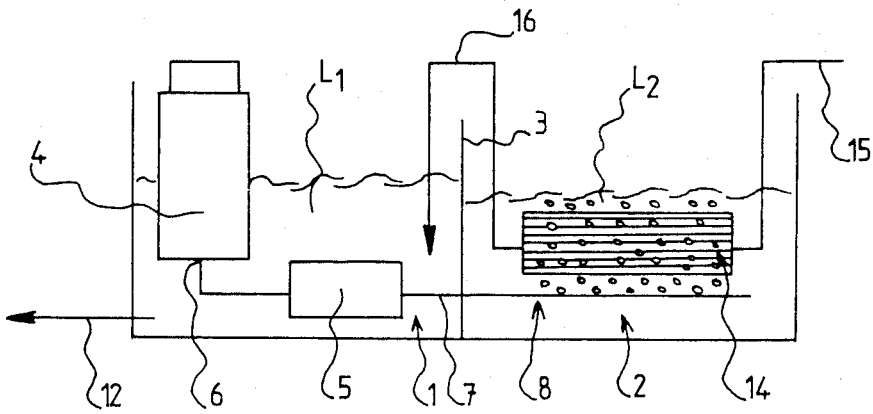
FIG. 3 is still a diagrammatic view showing another embodiment of this installation.

One may also produce hot water or heat the liquids with the help of the installation shown on FIG. 3, which uses an indirect heating embodiment for heating the liquid $L_1$ contained in the vat 1.

To this effect, the vat 2 is equipped with an exchanger 14 immersed in the liquid $L_2$ and comprising a liquid-supply duct 15 and an outlet duct 16 leading into the first vat 1. Such an arrangement will be advantageously used when there is an incompatibility between the fumes exiting out of the diffuser 8 and the bath in the vat 2, so that an exchanger such as 14 must be interposed. Then, in such a case, the liquid $L_2$ in the vat 2 is taken as an intermediate liquid which recovers the energy from the fumes by bubbling and transmits it to the liquid $L_1$ to be heated through the exchanger 14.

The calculations effected on the installation shown on FIG. 3 have shown that for a supply of cooled liquid at a temperature of 15° C. through the duct 15, for a temperature of the liquid $L_2$ equal to 40° C., and for a temperature of 85° C. of the liquid $L_1$ drawn off through the duct 2, a yield of 106% on the net heating value can be obtained.

With respect to the three embodiments of FIGS. 1, 2 and 3, it must be noted that the dimension of the exchanger 5, the volume of the two vats 1 and 2, and the amounts of liquid to be transferred must be optimized as a function of the rising of the temperature in the vats and the drawing off embodiments.

As for the alternative embodiments shown on FIGS. 2 and 3, the dimension of the exchanger 5 should be such that the remaining fraction of energy to be transmitted to the vat 2 be small so as to allow the obtention of a balanced temperature in this vat which is much lower than 60° C. The yields so far obtained exceed 100% on the net heating value.

It will be added here that, without departing from the scope of the invention, it is possible to place the vat 2 at a level lower than that of the vat 1 so as to avoid the flow up of the liquids which otherwise would risk providing undesirable thermal shocks.

Consequently, the invention provides an installation allowing the heating of the liquids at two levels of temperature with a single heating equipment, the heating yields of such an installation, based on the net heating value, exceeding 100%, either in the case where a single liquid at a temperature higher than 60° C. is used, or in the case where two liquids at respectively different temperatures are used, one temperature being higher than 60° C. and the other one being lower than 60° C.

Of course, the invention is by no means limited to the form of embodiment described and illustrated which has been given by way of example only.

The invention therefore includes all technical equivalents to the means described as well as their combinations if the latter are carried out according to its gist.

What we claim is:

1. A heating installation comprising a first vat (1) containing a first liquid (L1), a second vat (2) containing a second liquid (L2), partition wall means (3) for separating the first liquid from the second liquid, an exchanger (5) immersed in the first liquid of said first vat (1), a burner (4) connected to said exchanger (5) for heating the first liquid through said exchanger and diffusing means (8) connected to said exchanger and immersed into the second liquid of said second vat (2) for independently heating the second liquid (L2) at a temperature different from and lower than that of the first liquid (L1) in said first vat.

2. A heating installation according to claim 1, wherein the first liquid of said first val (1) is heated at a temperature higher than about 60° C. and the second liquid is heated independently from the first liquid at a temperature lower than about 60° C.

3. A heating installation according to claim 1, further comprising at least one pump (P) for transferring the liquid from one vat to the other.

4. A heating installation according to claim 1, further comprising an exchanger (14) immersed into the second liquid (L2) of said second vat (2) and being arranged above said diffusing means (8) and comprising a liquid supply duct (15) and an outlet (16) communicating with the first liquid (L1) of said first vat (1).

5. The installation of claim 1, wherein said partition wall means comprise a partition wall completely separating said first and second vats from one another.

* * * * *